US008344606B2

(12) United States Patent
Son et al.

(10) Patent No.: US 8,344,606 B2
(45) Date of Patent: Jan. 1, 2013

(54) FIELD EMISSION DEVICE

(75) Inventors: Yoon-chul Son, Hwaseong-si (KR); Yong-chul Kim, Seoul (KR); In-taek Han, Seoul (KR); Ho-suk Kang, Seoul (KR)

(73) Assignee: Samsung Electronics Co., Ltd. (KR)

( * ) Notice: Subject to any disclaimer, the term of this patent is extended or adjusted under 35 U.S.C. 154(b) by 758 days.

(21) Appl. No.: 12/467,401

(22) Filed: May 18, 2009

(65) Prior Publication Data

US 2010/0164355 A1 Jul. 1, 2010

(30) Foreign Application Priority Data

Dec. 26, 2008 (KR) ..... 10-2008-0134970

(51) Int. Cl.
*H01J 17/49* (2012.01)

(52) U.S. Cl. ..... 313/311; 313/495

(58) Field of Classification Search ..... 313/495–497, 313/311

See application file for complete search history.

(56) References Cited

U.S. PATENT DOCUMENTS

| | | | | |
|---|---|---|---|---|
| 6,630,772 | B1 * | 10/2003 | Bower et al. | 313/311 |
| 2001/0025962 | A1 | 10/2001 | Nakamoto | |
| 2006/0017363 | A1 * | 1/2006 | Wei et al. | 313/311 |
| 2008/0018228 | A1 * | 1/2008 | Choi et al. | 313/497 |

FOREIGN PATENT DOCUMENTS

| | | | |
|---|---|---|---|
| KR | 1020030088063 | A | 11/2003 |
| KR | 1020070001769 | A | 1/2007 |

* cited by examiner

*Primary Examiner* — Anne Hines
(74) *Attorney, Agent, or Firm* — Cantor Colburn LLP

(57) ABSTRACT

A field emission device includes a substrate including a groove; a metal electrode disposed on a bottom surface of the groove; and a carbon nanotube ("CNT") emitter. The CNT emitter includes an intermetallic compound layer disposed on the metal electrode and CNTs disposed on the intermetallic compound layer.

8 Claims, 6 Drawing Sheets

FIELD EMISSION DEVICE

CROSS-REFERENCE TO RELATED APPLICATIONS

This application claims priority to Korean Patent Application No. 10-2008-0134970, filed on Dec. 26, 2008, and all the benefits accruing therefrom under U.S.C. §119, the contents of which in its entirety are herein incorporated by reference.

BACKGROUND

1. Field

One or more embodiments relate to a field emission device and a method of manufacturing the same.

2. Description of the Related Art

Field emission devices emit electrons from emitters formed on cathodes by forming a strong electric field around the emitters. Field emission devices may be applied to field emission displays ("FEDs"), which display images by the collision of electrons emitted from a field emission device with a phosphor layer formed on anodes, backlight units ("BLUs") of liquid crystal displays ("LCDs"), and the like. LCDs display images on a front surface by passing light, which may be generated by a light source installed on a rear surface, through a liquid crystal, which controls light transmittance. Examples of the light source installed on the rear surface of the LCDs may include a cold cathode fluorescence lamp ("CCFL") BLU, a white light emitting diode ("WLED") BLU and a field emission BLU. The CCFL BLU provides desirable color reproducibility and can be manufactured at low cost. However, since the CCFL BLU uses Hg, the CCFL BLU may pollute the environment, and because the CCFL BLU may not be dynamically controlled the CCFL BLU may not increase brightness and contrast. The WLED BLU can be dynamically controlled, but incurs high manufacturing costs and has a complicated structure. The field emission BLU can be locally dimmed and impulse/scan-driven to thereby maximize brightness, contrast and the quality of motion pictures. Thus, a field emission BLU having low manufacturing cost is desirable for use as a next-generation BLU. The field emission devices may also be applied to other various systems using electron emission, such as X-ray tubes, microwave amplifiers and flat lamps.

Micro tips formed of a metal such as molybdenum (Mo) have been used as emitters in field emission devices. Also, in some commercial field emission devices, carbon nanotubes ("CNTs"), which provide good electron emission, are used as emitters. Field emission devices using CNT emitters are low-priced, are driven with a low voltage and have good chemical and mechanical stability.

Commercially available field emission devices are currently manufactured by performing photo patterning and firing several times, thus their manufacture is complicated and expensive. More specifically, metal electrodes, such as cathodes, may be roughly formed in two ways. In a first way, Cr, Mo or the like is deposited by vacuum deposition and then patterned by photolithography. In a second way, Ag or the like is stencil-printed and then fired. However, the first way requires vacuum deposition equipment and is complicated, and in the second way an expensive material is used, thus the resulting field emission devices are manufactured at high cost. Accordingly, there remains a need in the art for a lower cost field emission device.

SUMMARY

One or more embodiments include a field emission device and a method of manufacturing the same.

Additional aspects are set forth in the description which follows.

To achieve the above and/or other aspects, features or advantages, one or more embodiments includes a field emission device including a substrate comprising a groove; a metal electrode disposed on a bottom surfaces of the groove; and a carbon nanotube ("CNT") emitter comprising an intermetallic compound layer disposed on the metal electrode and CNTs disposed on the intermetallic compound layer.

The metal electrode may comprise a material selected from the group consisting of Ni, Co, Cu, Au, Ag and a combination comprising at least one of the foregoing.

The intermetallic compound layer may include Sn and a material, which is used to form the metal electrode.

The CNT emitter may further include a fired paste, the fired paste derived from a mixture comprising CNTs and an organic binder. The CNTs may be exposed outside of the fired paste.

To achieve the above and/or other aspects, features or advantages, one or more embodiments includes a field emission device including a substrate; an insulation layer disposed on the substrate and comprising a groove disposed in the insulation layer, wherein the groove exposes a surface of the substrate; a metal electrode disposed on the surface of the substrate, which is exposed via the groove; and a CNT emitter including an intermetallic compound layer disposed on the metal electrode and CNTs disposed on the intermetallic compound layer.

To achieve the above and/or other aspects, features or advantages, one or more embodiments includes a method of manufacturing a field emission device, the method includes disposing a groove in a substrate; disposing a metal electrode on a bottom surface of the groove; disposing a paste, the paste comprising CNTs, an organic binder and Sn particles, on the metal electrode; and forming an intermetallic compound layer on the metal electrode by firing the paste.

The metal electrode may be formed by electroless plating. The metal electrode may include a material selected from the group consisting of Ni, Co, Cu, Au, Ag and a combination including at least one of the foregoing. The method may further include disposing a seed layer on the bottom surface of the groove, the seed layer facilitating electroless plating.

The Sn particles may consist of Sn or an alloy including a material selected from the group consisting of Ag, Cu, W, Mo, Co, Ti, Zr, Zn, V, Cr, Fe, Nb, Re, Mn and a combination comprising at least one of the foregoing and Sn.

The paste may be fired at a temperature between about 250° C. and about 600° C. The CNTs may be exposed outside of a fired paste by the firing of the paste.

To achieve the above and/or other aspects, features or advantages, one or more embodiments may include a method of manufacturing a field emission device, the method includes disposing a metal layer on a substrate; forming a metal electrode by patterning the metal layer; disposing an insulation layer on the substrate so as to cover the metal electrode; forming a groove exposing the metal electrode by patterning the insulation layer; disposing a paste comprising CNTs, an organic binder and Sn particles, on the metal electrode; and forming an intermetallic compound layer on the metal electrode by firing the paste.

According to the one or more of the above embodiments, a metal electrode is formed on a substrate by electroless plating, and thus, may be manufactured without vacuum deposition and exposure equipment. Consequently, the costs for manufacturing the field emission devices of the one or more of the above embodiments can be reduced. In addition, since CNTs are exposed outside of a paste due to firing of the paste, the CNTs may be activated without a special CNT activation process.

BRIEF DESCRIPTION OF THE DRAWINGS

These and/or other aspects will become apparent and more readily appreciated from the following description of the embodiments, taken in conjunction with the accompanying drawings in which.

DETAILED DESCRIPTION

Figure 1:
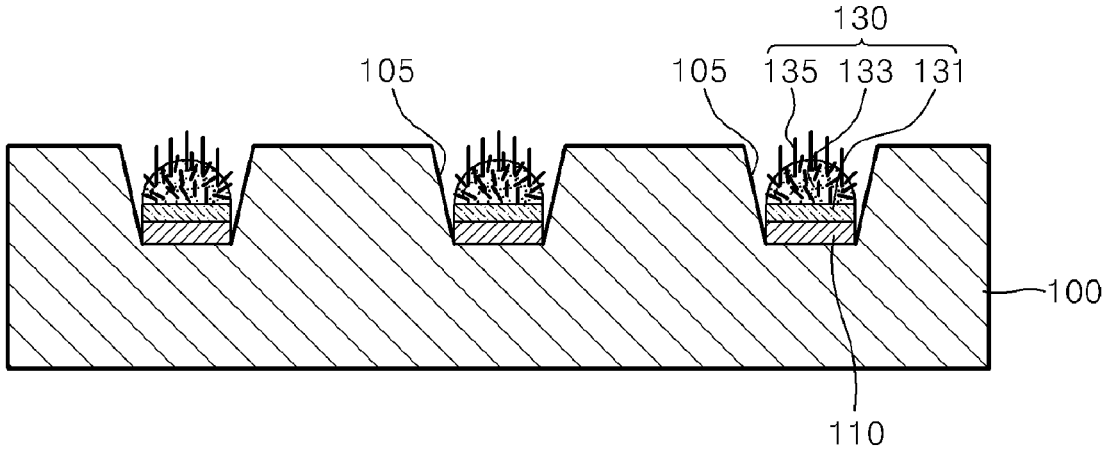
FIG. 1 is a cross-section view illustrating an exemplary embodiment of a field emission device.

Reference will now be made in further detail to embodiments, examples of which are illustrated in the accompanying drawings, wherein like reference numerals refer to like elements throughout and the thicknesses of layers and regions are exaggerated for clarity. In this regard, the present embodiments may have different forms and should not be construed as being limited to the descriptions set forth herein. Accordingly, the embodiments are merely described below, by referring to the figures, to explain aspects of the present description.

It will be understood that when an element or layer is referred to as being "on" or "connected to" another element or layer, the element or layer can be directly on or connected to another element or layer or intervening elements or layers. In contrast, when an element is referred to as being "directly on" or "directly connected to" another element or layer, there are no intervening elements or layers present. As used herein, the term "and/or" includes any and all combinations of one or more of the associated listed items.

It will be understood that, although the terms first, second, third, etc., can be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the exemplary embodiments of the invention.

Spatially relative terms, such as "below," "lower," "upper" and the like, can be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "lower" relative to other elements or features would then be oriented "above" relative to the other elements or features. Thus, the exemplary term "below" can encompass both an orientation of above and below. The device can be otherwise oriented (rotated 90 degrees or at other orientations) and the spatially relative descriptors used herein interpreted accordingly.

As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the invention are described herein with reference to cross-section illustrations that are schematic illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing.

For example, an implanted region illustrated as a rectangle will, typically, have rounded or curved features and/or a gradient of implant concentration at its edges rather than a binary change from implanted to non-implanted region. Likewise, a buried region formed by implantation can result in some implantation in the region between the buried region and the surface through which the implantation takes place. Thus, the regions illustrated in the figures are schematic in nature and their shapes are not intended to illustrate the actual shape of a region of a device and are not intended to limit the scope of the invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

All methods described herein can be performed in a suitable order unless otherwise indicated herein or otherwise clearly contradicted by context. The use of any and all examples, or exemplary language (e.g., "such as"), is intended merely to better illustrate the invention and does not pose a limitation on the scope of the invention unless otherwise claimed. No language in the specification should be construed as indicating any non-claimed element as essential to the practice of the invention as used herein.

FIG. 1 is a cross-section view illustrating an exemplary embodiment of a field emission device. Referring to FIG. 1, the field emission device includes a substrate 100 in which a groove 105 is disposed, and a metal electrode 110 and a carbon nanotube ("CNT") emitter 130, which are disposed respectively in the groove 105.

The substrate 100 may comprise a glass, a plastic, or the like or a combination comprising at least one of the foregoing. In an embodiment, the substrate 100 may consist essentially of a glass, a plastic, or the like or a combination thereof. In another embodiment, the substrate 100 may consist of a glass, a plastic, or the like or a combination thereof. The groove 105 is disposed in the substrate 100 to have a selected depth. A plurality of grooves 105 may be disposed parallel to one another, for example, as strips, in the substrate 100, however the present invention is not limited thereto.

Figure 5:
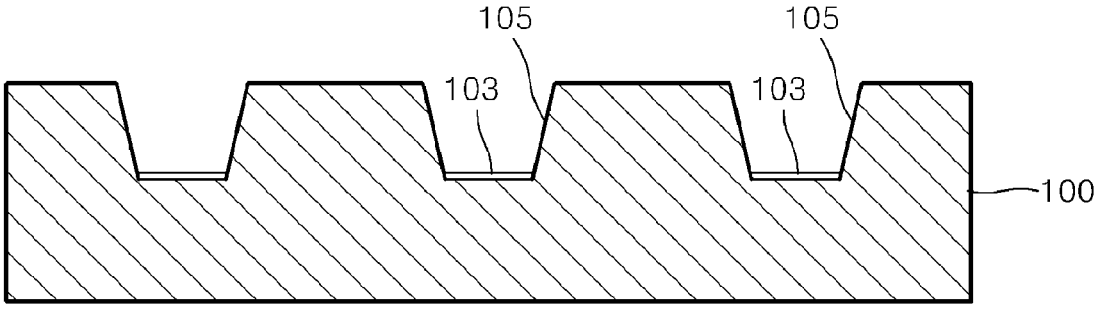

The metal electrode 110 is disposed on a bottom surface of the groove 105 and corresponds to a cathode. The metal electrode 110 may comprise a material selected from the group consisting of Ni, Co, Cu, Au, Ag, and the like and a combination comprising at least one of the foregoing. In an embodiment, the metal electrode 110 may consist essentially of a material selected from the group consisting of Ni, Co, Cu, Au, Ag, and the like and a combination thereof. In another embodiment, the metal electrode 110 may consist of a material selected from the group consisting of Ni, Co, Cu, Au, Ag and a combination thereof. The metal electrode 110 may be formed by electroless plating as further described below. Although not shown in FIG. 1, a seed layer 103 (see FIG. 5) may be further disposed between the bottom surface of the groove 105 and the metal electrode 110. The seed layer 103 facilitates the electroless plating of the metal electrode 110, and may include a material selected from the group consisting of Pd, Sn, a Pd—Sn alloy, dimethylamine borane ("DMAB"), and the like and a combination comprising at least one of the foregoing. In an embodiment, the seed layer 103 consists essentially of a material selected from the group consisting of Pd, Sn, a Pd—Sn alloy, DMAB, and the like and a combination thereof. In another embodiment, the seed layer 103 consists of a material selected from the group consisting of Pd, Sn, a Pd—Sn alloy, DMAB and a combination thereof.

The CNT emitter 130 is disposed on the metal electrode 110 and is used for electron emission. The CNT emitter 130 includes an intermetallic compound layer 131 disposed on the metal electrode 110, and CNTs 135 disposed on the intermetallic compound layer 131. The CNT emitter 130 may further include a fired paste 133, derived from a mixture in which an organic binder, the CNTs 135, and the like, are included. The CNTs 135 may be exposed outside of the fired paste 133. The fired paste 133 may further include a metal selected from the group consisting of Sn, Ag, Cu, W, Mo, Co, Ti, Zr, Zn, V, Cr, Fe, Nb, Re, Mn, and the like and a combination comprising at least one of the foregoing. In an embodiment, the fired paste 133 may consist essentially of CNTs and a metal selected from the group consisting of Sn, Ag, Cu, W, Mo, Co, Ti, Zr, Zn, V, Cr, Fe, Nb, Re, Mn, and the like and a combination thereof.

The intermetallic compound layer 131 includes a material used to form the metal electrode 110 and Sn. In an embodiment, the intermetallic compound layer 131 may comprise an intermetallic compound formed by treating the material used to form the metal electrode 110 with Sn. In an embodiment, the intermetallic compound layer 131 may consist essentially of an intermetallic compound formed by treating the material used to form the metal electrode 110 with Sn. In another embodiment, the intermetallic compound layer 131 may consist of an intermetallic compound formed by treating the material used to form the metal electrode 110 with Sn.

Figure 7:
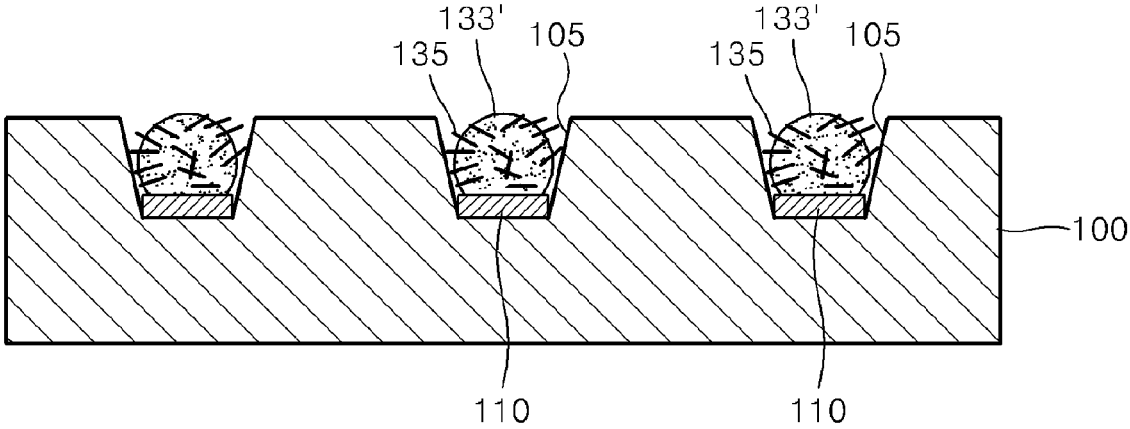

As further described below, the CNT emitter 130 may be formed by coating an upper surface of the metal electrode 110 with a paste 133' of FIG. 7, in which the CNTs 135, an organic binder, and Sn particles are included, and then, by firing the paste 133' at a selected temperature, for example, at a temperature between about 250° C. and about 600° C., specifically between about 300° C. and 550° C., more specifically between about 350° C. and about 500° C. While not wanting to be bound by theory, it is believed that by firing the paste 133', the Sn particles included in the paste 133' melt and react with the material used to form the metal electrode 110, thereby forming the intermetallic compound layer 131. In addition, the CNTs 135 are exposed outside of the fired paste 133. Although not shown in FIG. 1, a gate electrode (not shown) for electron extraction may be further disposed on a portion of the upper surface of the substrate 100. In an embodiment wherein a plurality of grooves are present, a gate electrode (not shown) for electron extraction may be further disposed on a portion of the upper surface of the substrate 100, which is between the grooves.

Figure 2:
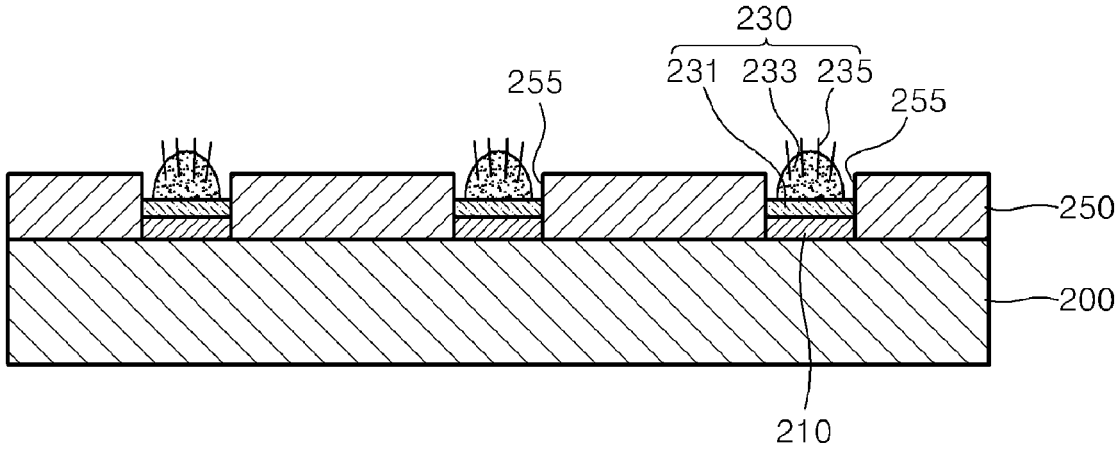
FIG. 2 is a cross-section view illustrating another exemplary embodiment of a field emission device.

FIG. 2 is a cross-section view illustrating another exemplary embodiment of a field emission device. The field emission device of FIG. 2 is described in terms of differences between the field emission device of the embodiment shown in FIG. 1 and the field emission device of the embodiment shown in FIG. 2.

Referring to FIG. 2, the field emission device includes a substrate 200, an insulation layer 250 in which a groove 255 is disposed, and a metal electrode 210 and a CNT emitter 230, which are respectively disposed in the groove 255.

The insulation layer 250 is disposed on the substrate 200 to have a selected thickness and includes the groove 255, which exposes a portion of the surface of the substrate 200. The metal electrode 210 is disposed on the exposed portion of the surface of the substrate 200. As described above, the metal electrode 210 may comprise a material selected from the group consisting of Ni, Co, Cu, Au, Ag, and the like and a combination comprising at least one of the foregoing. In an embodiment, the metal electrode 210 may consist essentially of a material selected from the group consisting of Ni, Co, Cu, Au, Ag, and the like and a combination thereof. In another embodiment, the metal electrode 210 may consist of a material selected from the group consisting of Ni, Co, Cu, Au, Ag and a combination thereof. Although not shown in FIG. 3, a seed layer may be further disposed between the exposed portion of the surface of the substrate 200 and the metal electrode 210.

The CNT emitter 230 is disposed on the metal electrode 210 and is used for electron emission. The CNT emitter 230 includes an intermetallic compound layer 231 disposed on the metal electrode 210, and CNTs 235 disposed on the intermetallic compound layer 231. The intermetallic compound layer 231 includes Sn and a material used to form the metal electrode 210. The CNT emitter 230 may further include a fired paste 233 derived from a mixture in which an organic binder, the CNTs 235, and the like, are included. The CNTs 235 may be exposed outside of the fired paste 233. Although not shown in FIG. 2, a gate electrode (not shown) for electron extraction may be further disposed on a portion of the upper surface of the insulation layer 250. In an embodiment wherein a plurality of grooves are present, a gate electrode (not shown) for electron extraction may be further disposed on a portion of the upper surface of the insulation layer 250, which is between the grooves.

A method of manufacturing the aforementioned field emission device is disclosed herein. FIGS. 3 through 8 are cross-section views illustrating an exemplary embodiment of a method of manufacturing the field emission device of FIG. 1.

Figure 3:
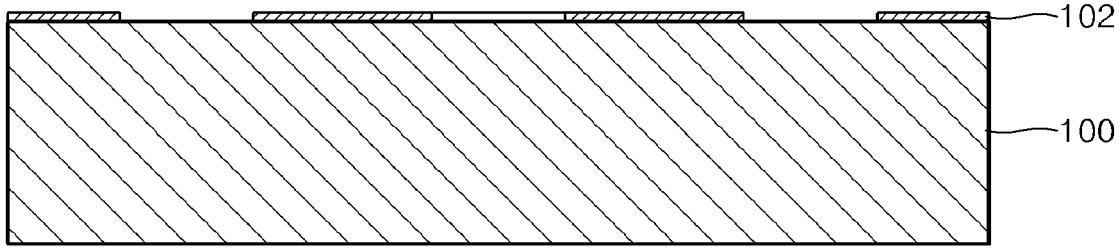
FIGS. 3 through 8 are cross-section views illustrating an exemplary embodiment of a method of manufacturing the field emission device illustrated in FIG. 1.

Referring to FIG. 3, first, a substrate 100 is disposed. A glass substrate may be used as the substrate 100. In another embodiment, a plastic substrate or the like may also be used as the substrate 100. Then, an etch mask 102 having a selected pattern is disposed on the substrate 100. The etch mask 102 may be formed by disposing a material layer on the upper surface of the substrate 100 and patterning the material layer.

Figure 4:
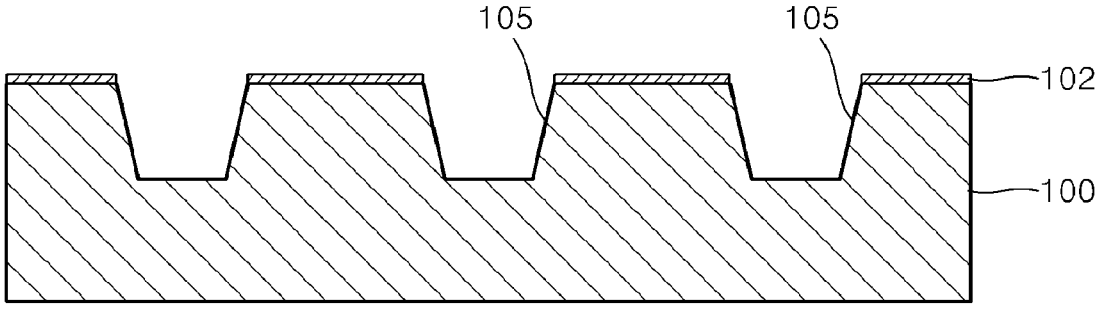

Referring to FIG. 4, a portion of the upper surface of the substrate 100, which is exposed via the etch mask 102, is subject to, for example, etching or sand blasting, thereby forming the groove 105 having a selected depth. Next, referring to FIG. 5, a seed layer 103 may be disposed on the bottom surface of the groove 105 to facilitate electroless plating, which is later performed to form the metal electrode 110. The seed layer 103 may include a material selected from the group consisting of Pd, Sn, a Pd—Sn alloy, DMAB, and the like and a combination comprising at least one of the foregoing, however the present invention is not limited thereto. The seed layer 103 may be formed by coating a solution including a material selected from the group consisting of Pd, Sn, a Pd—Sn alloy, DMAB, and the like and a combination comprising at least one of the foregoing on the structure of FIG. 4 and then removing the etch mask 102. The coating of the solution on the structure of FIG. 4 may be performed by dipping, stencil printing, inkjet printing, or the like or a combination comprising at least one of the foregoing coating methods.

Figure 6:
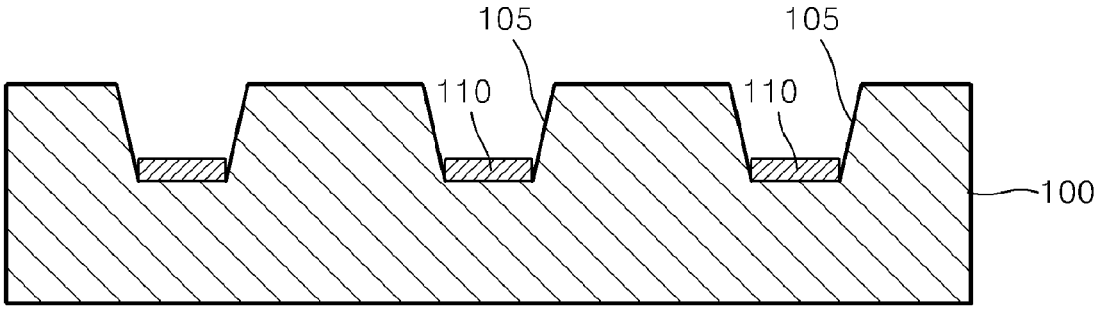

Referring to FIG. 6, a metal electrode 110 is disposed on the seed layer 103 by electroless plating. For the sake of convenience, the seed layer 103 is not shown in FIG. 6, and likewise in the following figures. The metal electrode 110 may comprise a material selected from the group consisting of Ni, Co, Cu, Au, Ag, and the like and a combination comprising at least one of the foregoing, however the present invention is not limited thereto. In an embodiment wherein the metal electrode 110 is formed of Ni for example, P or B may be added to the Ni. In another embodiment wherein the metal electrode 110 is formed of Co for example, P may be added to the Co. Next, referring to FIG. 7, the upper surface of the metal electrode 110 is coated with a paste 133' in which the CNTs 135, an organic binder, and Sn particles are included. The coating may be performed by printing, or the like, however the present invention is not limited thereto. The Sn particles may have a diameter between about 10 nanometers ("nm") and about 100 micrometers ("μm"), specifically between about 0.1 μm and about 50 μm, more specifically between about 1 μm and about 10 μm. The Sn particles have a melting point between about 200° C. and about 250° C., more specifically about 232° C. The Sn particles may consist of Sn or may comprise an alloy obtained by adding a material selected from the group consisting of Ag, Cu, W, Mo, Co, Ti, Zr, Zn, V, Cr, Fe, Nb, Re, Mn, and the like and a combination comprising at least one of the foregoing to Sn. In an embodiment, the Sn particles may consist essentially of an alloy obtained by adding a material selected from the group consisting of Ag, Cu, W, Mo, Co, Ti, Zr, Zn, V, Cr, Fe, Nb, Re, Mn, and the like and a combination thereof to Sn. In another embodiment, the Sn particles may consist of an alloy obtained by adding a material selected from the group consisting of Ag, Cu, W, Mo, Co, Ti, Zr, Zn, V, Cr, Fe, Nb, Re, Mn and a combination thereof to Sn. If the Sn particles comprise the alloy, the weight percentage of the alloy, based on the total weight of the alloy and the Sn, may be between about 0.1 weight percent ("wt %") and about 99 wt %, specifically between about 1 wt % and about 10 wt %, more specifically less than or equal to about 5 wt %, however the present invention is not limited thereto.

Figure 8:
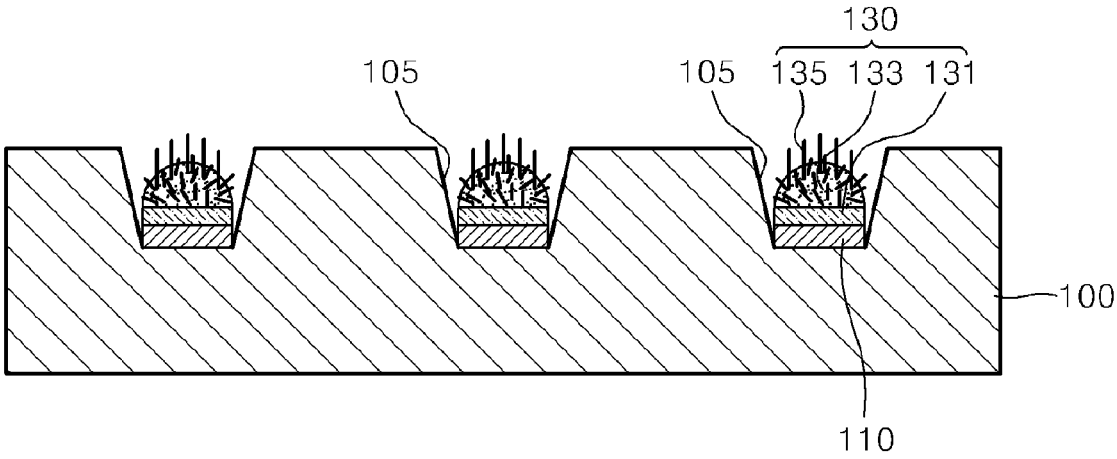

Referring to FIG. 8, the paste 133' disposed on the metal electrode 110 is fired at a selected temperature, thereby forming the CNT emitter 130. The paste 133' may be fired at a temperature between about 250° C. and about 600° C., specifically between about 300° C. and 550° C., more specifically between about 350° C. and about 500° C., however the present invention is not limited thereto. When the paste 133' is fired, intermetallic compound layer 131 is formed on the metal electrode 110. More specifically, while not wanting to be bound by theory, it is believed that when the paste 133' is fired at a selected temperature, the Sn particles included in the paste 133' melt and move downward. The melted Sn reacts with the material used to form the metal electrode 110, thereby respectively forming the intermetallic compound layer 131 on the metal electrode 110. If the metal electrode 110 comprises electroless-plated Ni, the intermetallic compound layer 131 may comprise an intermetallic compound including Sn and Ni, for example, $Ni_3Sn_4$. The Sn particles included in the paste 133' may melt and move downward by the firing process, and thus, the CNTs 135 included in the unfired paste 133' are naturally exposed to the outside of the fired paste 133. Although not shown in FIG. 8, if Sn remains in the paste 133' after a firing process, Sn layers may be respectively formed on the intermetallic compound layers 131.

Figure 9:
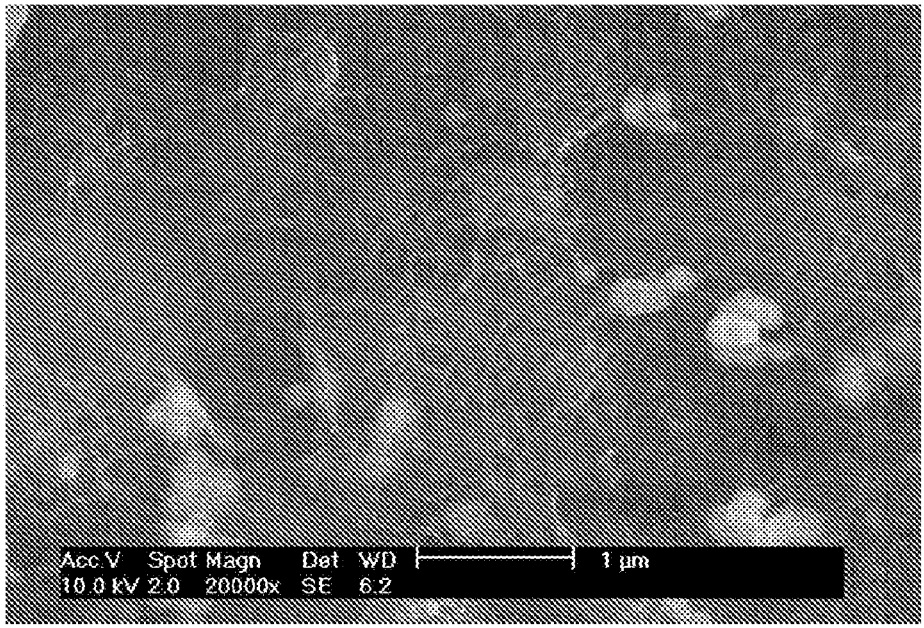
FIG. 9 is a scanning electron microscope ("SEM") picture of a surface of the field emission device illustrated in FIG. 1.
Figure 10:
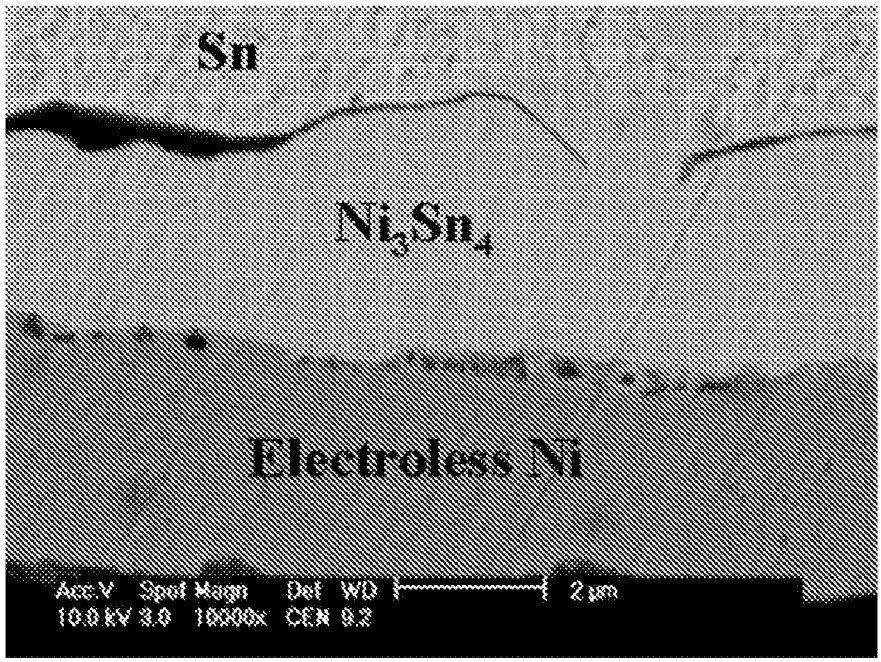
FIG. 10 is an SEM picture of a cross-section of the field emission device illustrated in FIG. 1.

FIG. 9 is a scanning electron microscope ("SEM") picture of a surface of the field emission device illustrated in FIG. 1. The surface shown in FIG. 9 is obtained after firing a paste including CNTs and Sn particles. FIG. 10 is an SEM picture of a cross-section of the field emission device illustrated in FIG. 1. The cross-section of FIG. 10 is obtained after firing the paste including CNTs and Sn particles. Metal electrodes formed of Ni were formed by electroless plating, and phosphorus (P) of 3-4 wt % was added to the metal electrodes. In order to facilitate the electroless Ni plating, the surface of a glass substrate was subject to etching and palladium (Pd) treatment. The upper surfaces of the metal electrodes were each coated with a paste manufactured by mixing 50 grams ("g") of an organic binder, 5 g of multi-wall CNTs, Sn particles, and 70 g of a flux, and the paste, coated on the metal electrodes, was fired at 460° C. for 30 minutes.

Referring to FIG. 9, a large amount of CNTs are exposed after the firing of the paste. Referring to FIG. 10, after the Sn particles included in the paste melted and moved, due to the firing of the paste, the Sn particles reacted with Ni, and intermetallic compound layers composed of $Ni_3Sn_4$ were formed. Sn, which remained in the paste by not reacting with Ni, melted to form Sn layers.

FIGS. 11 through 16 are cross-section views illustrating an exemplary embodiment of a method of manufacturing the field emission device of FIG. 2. The method illustrated in FIGS. 11 through 16 is described in terms of differences between the method of the embodiment shown in FIGS. 3 through 8 and the method of the embodiment shown in FIGS. 11 through 16.

Figure 11:
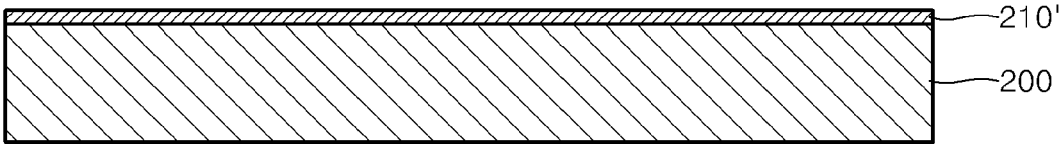
FIGS. 11 through 16 are cross-section views illustrating an exemplary embodiment of a method of manufacturing the field emission device illustrated in FIG. 2.

Referring to FIG. 11, a substrate 200 is disposed and then a metal layer 210' is formed on the substrate 200 by electroless plating. The metal layer 210' may comprise a material selected from the group consisting of Ni, Co, Cu, Au, Ag, and the like and a combination comprising at least one of the foregoing, however the present invention is not limited thereto. If the metal layer 210' is formed of Ni for example, P or B may be added to the Ni. If the metal layer 210' is formed of Co for example, P may be added to the Co. A seed layer (not shown) may be disposed on the upper surface of the substrate 200 before the metal layer 210' is formed, to facilitate electroless plating, which may be later performed to form the metal layer 210'. The seed layer may include a material selected from the group consisting of Pd, Sn, a Pd—Sn alloy, DMAB, and the like and a combination comprising at least one of the foregoing, however the present invention is not limited thereto.

Figure 12:
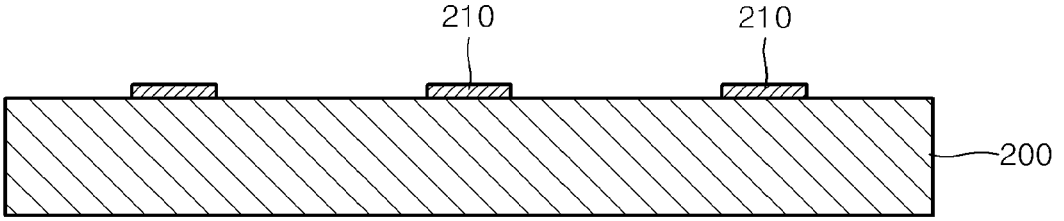
Figure 13:
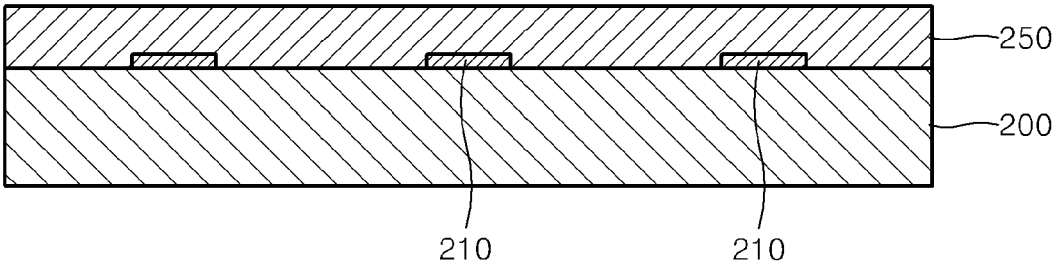
Figure 14:
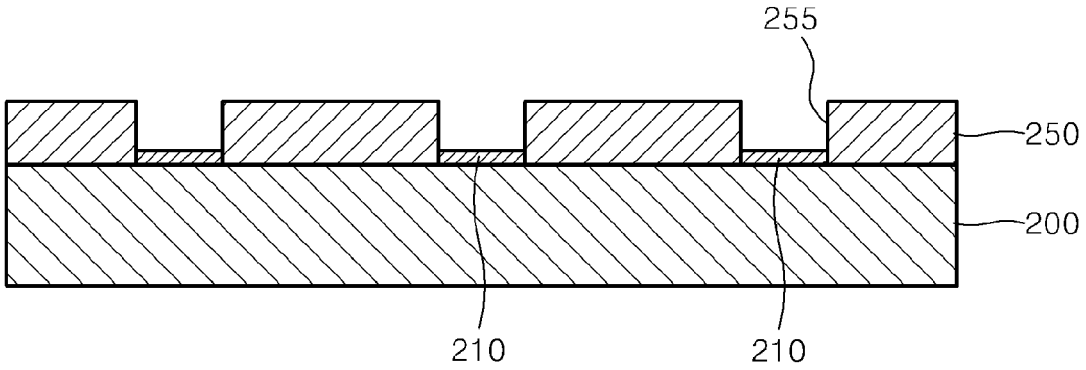

Referring to FIG. 12, the metal layer 210' is patterned so as to form a metal electrode 210 on the substrate 200. Referring to FIG. 13, an insulation layer 250 is disposed on the substrate 200 to have a selected thickness and to cover the metal electrode 210. Next, referring to FIG. 14, the insulation layer 250 is patterned so as to form a groove 255 in the insulation layer 250 in order to expose the metal electrode 210.

Figure 15:
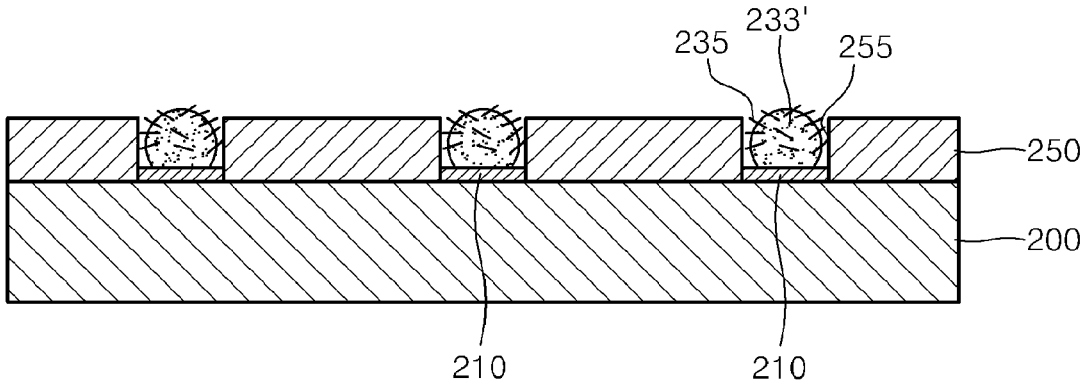

Referring to FIG. 15, the upper surface of the metal electrode 110, which is exposed via the groove 255, is coated with a paste 233' in which CNTs 235, an organic binder, and Sn particles are included. The coating may be performed by printing, or the like, however the present invention is not limited thereto. As described above, the Sn particles may have a diameter between about 10 nm and about 100 μm, specifically between about 0.1 μm and about 50 μm, more specifically between about 1 μm and about 10 μm, and may consist of Sn or an alloy of Sn and a metal material selected from the group consisting of Ag, Cu, W, Mo, Co, Ti, Zr, Zn, V, Cr, Fe, Nb, Re, Mn, and the like and a combination comprising at least one of the foregoing.

Figure 16:
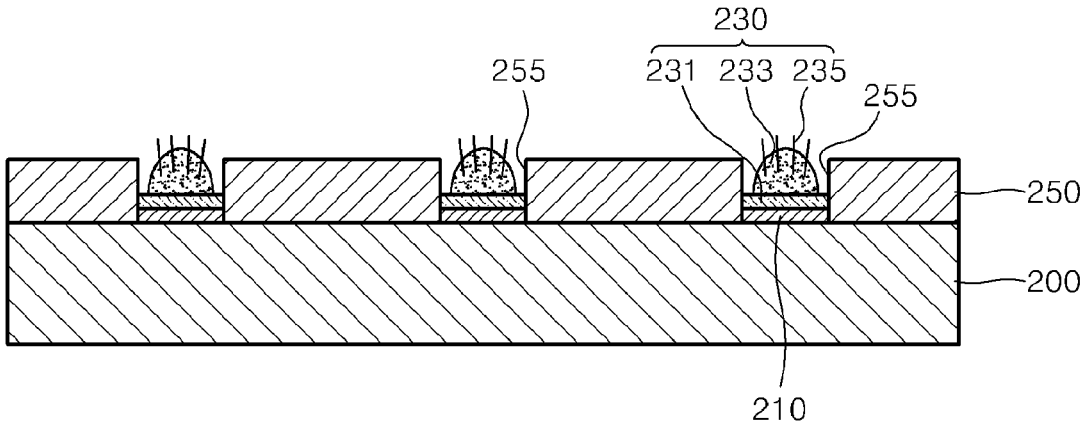

Referring to FIG. 16, the paste 233' disposed on the metal electrode 210 is fired at a selected temperature, thereby forming CNT emitter 230. The paste 233' may be fired at a temperature between about 250° C. and about 600° C., specifically between about 300° C. and 550° C., more specifically between about 350° C. and about 500° C. When the paste 233' is fired, intermetallic compound layer 231 is formed on the metal electrode 210. While not wanting to be bound by theory, it is believed that when the paste 233' is fired at a selected temperature, the Sn particles included in the paste 233' melt and move downward. The melted Sn reacts with the material used to form the metal electrode 210, thereby forming the intermetallic compound layer 231 on the metal electrode 210. The Sn particles included in the paste 233' melt and move downward by the firing process, and thus, the CNTs 235 included in the unfired paste 233' are naturally exposed outside of the fired paste 233.

As described above, according to one or more of the above embodiments, a metal electrode is formed by electroless plating, and thus may be manufactured without vacuum deposition equipment and exposure equipment. Consequently, the cost for manufacturing the field emission device of one or more of the above embodiments can be reduced. Furthermore, while an intermetallic compound is formed by melting and moving downward Sn included in a paste during the firing process, CNTs included in the past are naturally exposed to the outside. Therefore, a special CNT activation process is not needed, further simplifying manufacture and reducing cost. Moreover, since Sn has a low melting point and is easily oxidized, if firing is performed at a temperature equal to or greater than the melting point of Sn, the Sn is first oxidized within the paste. Thus, oxidization of the CNTs can be reduced or effectively prevented, and thus, the firing can be performed under an air atmosphere.

It should be understood that the exemplary embodiments described herein should be considered in a descriptive sense only and not for purposes of limitation. Descriptions of features, aspects and advantages within each embodiment should be considered as available for other similar features, aspects or advantages in other embodiments.

What is claimed is:

1. A field emission device comprising:

a substrate comprising a groove;

a metal electrode disposed on a bottom surface of the groove; and a carbon nanotube emitter comprising an intermetallic compound layer disposed on the metal electrode and carbon nanotubes disposed on the intermetallic compound layer, wherein the intermetallic compound layer comprises Sn and a material, which is used to form the metal electrode.

2. The field emission device of claim 1, wherein the metal electrode comprises a material selected from the group consisting of Ni, Co, Cu, Au, Ag and a combination comprising at least one of the foregoing.

3. The field emission device of claim 1, wherein the carbon nanotube emitter further comprises a fired paste, the fired paste derived from a mixture comprising carbon nanotubes and an organic binder.

4. The field emission device of claim 3, wherein the carbon nanotubes are exposed outside of the fired paste.

5. A field emission device comprising:

a substrate;

an insulation layer disposed on the substrate and comprising a groove disposed in the insulation layer, wherein the groove exposes a surface of the substrate;

a metal electrode disposed on the surface of the substrate, which is exposed via the groove; and a carbon nanotube emitter comprising an intermetallic compound layer disposed on the metal electrode and carbon nanotubes disposed on the intermetallic compound layer, wherein the intermetallic compound layer comprises Sn and a material which is used to form the metal electrode.

6. The field emission device of claim 5, wherein the metal electrode comprises a material selected from the group consisting of Ni, Co, Cu, Au, Ag and a combination comprising at least one of the foregoing.

7. The field emission device of claim 5, wherein the carbon nanotube emitter further comprises a fired paste, the fired paste derived from a mixture of carbon nanotubes and an organic binder.

8. The field emission device of claim 7, wherein the carbon nanotubes are exposed outside of the fired paste.

* * * * *